United States Patent [19]

Wisotsky et al.

[11] Patent Number: 4,877,541

[45] Date of Patent: Oct. 31, 1989

[54] CORROSION INHIBITOR

[75] Inventors: Max J. Wisotsky, Highland Park, N.J.; Stephen J. Metro, Pinehurst, N.C.

[73] Assignee: Exxon Research and Engineering Company, Florham Park, N.J.

[21] Appl. No.: 131,993

[22] Filed: Dec. 11, 1987

[51] Int. Cl.[4] ..... C10M 133/16

[52] U.S. Cl. ..... 252/47.5; 252/48.6; 252/51.5 A; 252/51.5 R; 252/56 S; 252/401; 252/402; 252/403

[58] Field of Search ..... 252/47.5, 51.5 A, 51.5 R, 252/48.6, 56 S, 401, 402, 403

[56] References Cited

U.S. PATENT DOCUMENTS

| | | | |
|---|---|---|---|
| 3,585,137 | 6/1971 | Bosniack et al. | 252/49.8 |
| 3,790,478 | 2/1974 | Rudston et al. | 252/49.8 |
| 3,850,824 | 11/1974 | Nebzydoski et al. | 252/50 |
| 3,914,179 | 10/1975 | Byford et al. | 252/56 S |
| 3,984,337 | 10/1976 | Braid | 252/51.5 A |
| 4,569,776 | 2/1986 | Miller et al. | 252/57 |

*Primary Examiner*—Jacqueline V. Howard

*Attorney, Agent, or Firm*—John W. Ditsler

[57] ABSTRACT

A corrosion inhibitor for use in synthetic ester lubricating oils is disclosed which comprises an effective amount of:

1. at least one aromatic amide; and
2. at least one hydroxy substituted aromatic compound.

The corrosion inhibitor thus formed is particularly useful in synthetic ester turbo lubricating oils.

29 Claims, No Drawings

CORROSION INHIBITOR

BACKGROUND OF THE INVENTION

1. Field of the Invention

The present invention relates to a metal corrosion inhibitor. More specifically, the invention concerns a corrosion inhibitor for use in a synthetic ester lubricating oil, particularly a synthetic ester turbo lubricating oil.

2. Description of Related Art

Lubricating oils are required to provide adequate lubrication over a wide range of operating conditions. In the case of turbo lubricating oils, synthetic basestocks normally are used to meet the wide operating range required of turbine engines in aircraft. As the operating conditions of the engines have become more severe (in part to achieve better fuel economy), the performance of lubricating oils has become more critical. The higher operating temperatures of the engine require greater thermal and oxidative stability of the basestock and additives. In addition, smaller clearances and tighter seals in the new engines result in considerably lower oil consumption. Hence, lubricating oil make-up rates for new engine designs are only a fraction of the make-up rates for older engine designs. As a result, turbo lubricating oils are now required which will perform at higher temperatures and for longer periods of time without degradation.

The use of amide-containing aromatics, such as anthranilamide, in lubricants for jet aircraft is known. For example, U.S. Pat. Nos. 3,585,137 and 3,850,824 (the disclosures of which are incorporated herein by reference) disclose the use of anthranilamide and its derivatives as a corrision inhibitor for turbo lubricating oil.

The use of substituted phenolics, such as propyl gallate, in lubricants also is known. For example, U.S. Pat. No. 3,790,478 (the disclosure of which is incorporated herein by reference) discloses the use of alkyl gallates (including propyl gallate) as a lead corrosion inhibitor in ester based lubricants.

While the addition of large amounts of the above-noted corrosion inhibitors may reduce the corrosion rate, the presence of such quantities in lubricating oils (particularly turbo lubricating oils) is undesirable because of their relatively low solubility (the solubility of anthranilamide and propyl gallate is only about 3000 and 2000 wppm, respectively, at 25° C.). U.S. Navy specification MIL-L-23699C requires that a turbo lubricating oil be clear and free of any suspended material. In addition to this specification, the use of a turbo lubricating oil containing suspended matter would not be desirable, since the insoluble material could cause engine damage and, possibly, engine shutdown.

Accordingly, in view of the deficiencies of the prior art, it would be desirable to have available a corrosion inhibitor which will be effective for relatively long periods of time at high operating temperatures. It also would be desirable to provide a corrosion inhibitor for a turbo lubricating oil which will be compatible with the basestock and with other additives normally present. Further, it would be desirable to provide a corrosion inhibitor which is effective within the solubility limits of the basestock and at relatively low concentrations to reduce or eliminate the formation of insoluble material in a lubricating oil.

SUMMARY OF THE INVENTION

Now according to the present invention, a particularly effective corrosion inhibitor for metal surfaces has been discovered, said inhibitor comprising an effective amount of certain substituted aromatic amides and certain hydroxy substituted aromatic compounds. The improved corrosion inhibition is due to a synergism between the two compounds which is not attained with similar quantities of either compound alone.

In a preferred embodiment, the abovedescribed corrosion inhibitor is incorporated into a synthetic ester lubricating oil containing other additives such as antioxidants, metal passivators, antiwear agents and the like. A particularly preferred application is use of the corrosion inhibitor in a synthetic ester turbo lubricating oil containing such additives.

DETAILED DESCRIPTION OF THE INVENTION

In one embodiment, the present invention relates to a combination of compounds as a corrosion inhibitor for metal surfaces (such as copper, lead and magnesium surfaces), particularly metal surfaces in jet aircraft engines. More specifically, the invention is directed to a corrosion inhibitor comprising:

I. At least one compound having the formula:

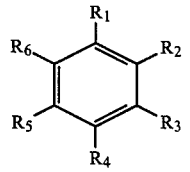

wherein $R_1$ is an amide, substituted amide or an ester; at least one substituent of $R_2$, $R_3$, $R_4$, $R_5$ and $R_6$ is an amide, substituted amide, amine or substituted amine; and the remaining substituents are independently hydrogen, hydroxyl or alkyl; and II. At least one compound having the formula

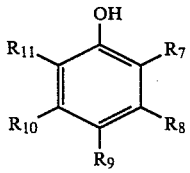

wherein at least one substituent of $R_7$–$R_{11}$ is an alkanoyl radical having the structure

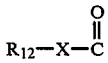

where R12 is alkyl, X is O, N or S; and the remaining $R_7$–$R_{11}$ substituents are hydrogen, alkyl, hydroxy, or ether functionality.

With respect to compound I, preferred compounds are compounds wherein $R_1$ is an amide or a mono- or di-substituted amide or mixtures thereof, $R_2$ is an amine and $R_3$–$R_6$ are hydrogen. A particularly preferred compound is anthranilamide which has the formula:

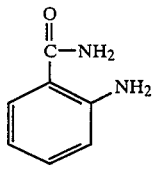

With respect to compound II, preferred compounds are carboxylic acid esters. Preferred compounds are those in which the aromatic ring has a substituted carboxyl group and three hydroxyl groups attached thereto, e.g.

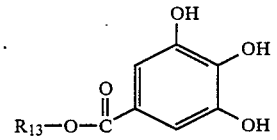

wherein $R_{13}$ is an alkyl group having between 1 and about 10 carbon atoms. Particularly preferred is propyl gallate which has the formula:

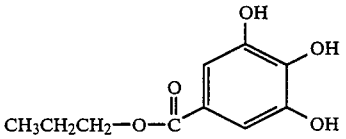

In another embodiment, the present invention relates to a synthetic ester lubricating oil which comprises a major amount of synthetic ester lubricating basestock (or base oil) and a minor amount of compounds I and II. The synthetic ester basestock may include diesters and "simple esters, complex esters and polyolesters" as those terms are defined in the recitation spanning column 3, line 45 through column 5, line 14 of U.S. Pat. No. 4,440,657, the entire disclosure of which is incorporated here by reference. When the corrosion inhibitor is utilized in a turbo lubricating oil, the basestock typically comprises one or more esters prepared by reacting neoalcohols (such as neopentylglycol, trimethylolpropane, pentaerythritol) with normal and iso acids having from 5 to 10 carbon atoms.

In addition to compounds I and II, other additives may be included in the synthetic ester lubricating oil of the present invention to form a fully formulated oil. Other additives that typically are present include antioxidants, metal deactivators, hydrolysis stabilizers and antiwear agents. Among the preferred additives are mono or di alkyldiphenyl amines, alkylated phenylnaphthyl amines, phenyl naphthylamines, phenothiazine, substituted phenothiazines and mixtures thereof as antioxidants. Triaryl phosphates, such as tricresyl phosphate and triphenyl phosphate, are preferred metal deactivators. Preferred hydrolysis stabilizers include those described in U.S. Pat. No. 4,440,657. Preferred antiwear agents include phosphate amine salts, such as hydrocarbyl substituted amine salts of mono and di substituted phosphoric acids.

In yet another embodiment, the present invention relates to a method for improving the metal corrosion inhibition of a synthetic ester lubricating oil by adding compounds I and II to said oil.

The concentration of compound I used in the various embodiments hereof should range between about 0.2 wt.% and about 0.5 wt.%, preferably between about 0.5 wt.% and about 0.3 wt.%, of the basestock. The concentration of compound II should range between about 0.01 and about 0.3 wt.%, preferably between about 0.03 and about 0.15 wt.%, of the basestock.

The present invention is of particular utility as a corrosion inhibitor for synthetic ester turbo lubricating oils which comply with specification MIL-L-23699C and with the specifications for commercial engine manufacturers, both of which require that the lubricating oil be clear and free of insoluble material.

The present invention will be further understood by reference to the following examples which are not intended to restrict the scope of the claims appended hereto.

COMPARATIVE EXAMPLE I

A lubricating oil comprising an ester basestock, antioxidants, a metal passivator, a hydrolysis stabilizer and an antiwear agent was prepared. In this example, 0.1 and 0.2 wt.% anthranilamide, based on basestock, was added to separate samples of the oil. The effectiveness of anthranilamide in reducing copper corrosion in each sample was then determined using the oxidation corrosion test described in Federal Test Method (FTM) Standard No. 791B, Method No. 5308, the disclosure of which is incorporated herein by reference. In this test, 100 ml of oil containing metal coupons of copper, magnesium, stainless steel, silver and aluminum is maintained at 400° F. for 72 hours while passing about 5 liters per hour of air through said oil. After 72 hours, the copper corrosion losses in milligrams for the samples containing 0.1 and 0.2 wt.% anthranilamide, based on basestock, were 0.27 and 0.18 milligrams, respectively. Corrosion losses for the other metals were well within specification limits.

COMPARATIVE EXAMPLE II

In this example, 0.1 and 0.2 wt.% propyl gallate rather than anthranilamide was used as the corrosion inhibitor in two samples of the lubricating oil described in Comparative Example I. The copper weight losses were then determined by the oxidation corrosion test and found to be 0.18 and 0.17 milligrams, respectively.

EXAMPLE 1

The lubricating oil of Comparative Example 1 was used with 0.1 wt.% anthranilamide and 0.1 wt.% propyl gallate, based upon the basestock. The copper weight loss measured by the oxidation corrosion test was only 0.03 milligrams.

EXAMPLE II

The lubricating oil of Comparative Example I again was used with 0.05 wt.% propyl gallate and 0.1 wt.% anthranilamide, based on basestock, as the corrosion inhibitor. The copper weight loss measured by the oxidation corrosion test was only 0.07 milligrams.

The data from Comparative Examples I and II and from Examples I and II are summarized in Table I.

TABLE I

| Example | Corrosion Inhibitor | Concentration (Wt. % on basestock) | Cu Weight Loss (mg) |
|---|---|---|---|
| Comp. | Anthranilamide | 0.1 | 0.27 |
| Ex. 1 | Anthranilamide | 0.2 | 0.18 |
| Comp. | Propyl gallate | 0.1 | 0.18 |

TABLE I-continued

| Example | Corrosion Inhibitor | Concentration (Wt. % on basestock) | Cu Weight Loss (mg) |
|---|---|---|---|
| Ex. 2 | Propyl gallate | 0.2 | 0.17 |
| Ex. 1 | Anthranilamide + Propyl gallate | 0.1 / 0.1 | 0.03 |
| Ex. 2 | Anthranilamide + Propyl gallate | 0.1 / 0.05 | 0.07 |

The data in Table 1 show that the combination of anthranilamide and propyl gallate unexpectedly results in significantly less corrosion than when anthranilamide and propyl gallate were used alone at the same concentration levels.

What is claimed is:

1. A corrosion inhibitor for metal surfaces comprising:

I. A compound having the formula:

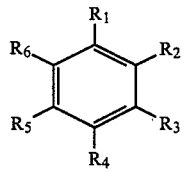

wherein $R_1$ is an amide, substituted amide or an ester; at least one substituent of $R_2$, $R_3$, $R_4$, $R_5$ and $R_6$ is an amide, substituted amide, amine or substituted amine; and the remaining substituents are independently hydrodgen, hydroxyl or alkyl; and II A compound having the formula

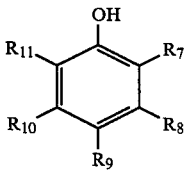

wherein at least one substituent of $R_7$–$R_{11}$ is an alkanoyl radical having the structure

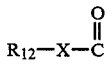

where R12 is alkyl, X is O, N or S; and the remaining $R_7$–$R_{11}$ substituents are hydrogen, alkyl, hydroxy, or ether functionality.

2. The composition of claim 1 wherein $R_1$ in compound I is an amide, a mono- or di- substituted amide or mixtures thereof, $R_2$ is an amine and $R_3$–$R_6$ are hydrogen.

3. The composition of claim 2 wherein X in compound II is oxygen.

4. The composition of claim 3 wherein at least one of $R_7$–$R_{11}$ in compound II is hydroxy.

5. The composition of claim 4 wherein at least two of $R_7$–$R_{11}$ in compound II are hydroxy.

6. The composition of claim 5 wherein $R_7$ and $R_8$ in compound II are hydroxy.

7. The composition of claim 6 wherein compound II has the formula:

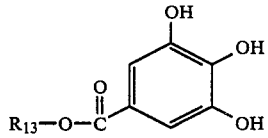

wherein $R_{13}$ is an alkyl group having between 1 and about 10 carbon atoms.

8. The composition of claim 7 wherein compound II comprises propyl gallate.

9. The composition of claim 8 wherein compound I comprises anthranilamide.

10. The composition of claim 1 wherein said metal surface comprises copper.

11. A synthetic ester lubricating oil composition which comprises:

(a) a major amount of synthetic ester basestock;

(b) a minor amount of the following compounds:

I. At least one compound having the formula

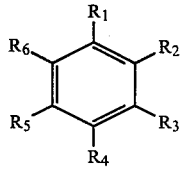

wherein $R_1$ is an amide, substituted amide, or an ester; at least one substituent of $R_2$, $R_3$, $R_4$, $R_5$ and $R_6$ is an amide, substituted amide, amine or substituted amine; and the remaining substituents are independently hydrogen, hydroxyl or alkyl; and, II. At least one compound having the formula

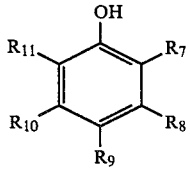

wherein at least one substituent of $R_7$–$R_{11}$ is an alkanoyl radical having the structure

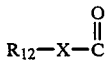

where R12 is alkyl, X is O, N or S; and the remaining $R_7$–$R_{11}$ substituents are hydrogen, alkyl, hydroxy, or ether functionality.

12. The composition of claim 11 wherein $R_1$ in compound I is an amide, a mono- or di- substituted amide or mixtures thereof, $R_2$ is an amine and $R_3$–$R_6$ are hydrogen.

13. The composition of claim 12 wherein compound II has the formula

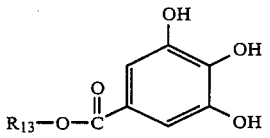

wherein $R_{13}$ is an alkyl group having between 1 and about 10 carbon atoms.

14. The composition of claim 13 wherein the concentration of compound I ranges between about 0.02 and about 0.5 wt.% of the basestock.

15. The composition of claim 14 wherein the concentration of compound II ranges between about 0.01 and about 0.3 wt.% of the basestock.

16. The composition of claim 15 wherein the compound I comprises anthranilamide.

17. The composition of claim 16 wherein the compound II comprises propyl gallate.

18. A method for improving the metal corrosion inhibition of a synthetic ester lubricating oil which comprises adding the following compounds to said oil I. A compound having the formula:

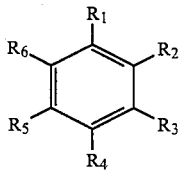

wherein $R_1$ is an amide, substituted amide or an ester; at least one substituent of $R_2$, $R_3$, $R_4$, $R_5$ and $R_6$ is an amide, substituted amide, amine or substituted amine; and the remaining substituents are independently hydrogen, hydroxyl or alkyl; and II. A compound having the formula

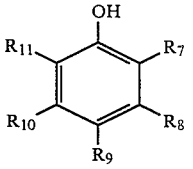

wherein at least one substituent of $R_7$–$R_{11}$ is an alkanoyl radical having the structure

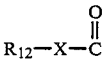

where R12 is alkyl, X is O, N or S; and the remaining $R_7$–$R_{11}$ substituents are hydrogen, alkyl, hydroxy, or ether functionality.

19. The method of claim 18 wherein $R_1$ in compound I is an amide, a mono- or di- substituted amide or mixtures thereof, $R_2$ is an amine and $R_3$–$R_6$ are hydrogen.

20. The method of claim 19 wherein compound II has the formula

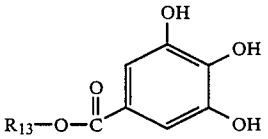

wherein $R_{13}$ is an alkyl group having between 1 and about 10 carbon atoms.

21. The method of claim 20 wherein the concentration of compound I ranges between about 0.02 and about 0.5 wt.% of the basestock.

22. The method of claim 21 wherein the concentration of compound II ranges between about 0.01 and about 0.3 wt.% of the basestock.

23. The method of claim 22 wherein compound I comprises anthranilamide.

24. The method of claim 23 wherein compound II comprises propyl gallate.

25. The method of claim 18 wherein said lubricating oil is a turbo lubricating oil.

26. The method of claim 25 wherein said oil also contains at least one phosphate amine salt.

27. The composition of claim 11 wherein at least one phosphate amine salt is present therein.

28. The composition of claim 17 wherein at least one phosphate amine salt is present therein.

29. The method of claim 18 wherein said oil also contains at least one phosphate amine salt.

* * * * *